US005492489A

United States Patent [19]

Chavakula

[11] Patent Number: 5,492,489

[45] Date of Patent: Feb. 20, 1996

[54] FOUR WAY AUDIO CABLE ADAPTER

[76] Inventor: Anand K. Chavakula, P.O. Box 1080, Lanham, Md. 20703

[21] Appl. No.: 264,942

[22] Filed: Jun. 24, 1994

[51] Int. Cl.[6] ..... H01R 25/00

[52] U.S. Cl. ..... 439/655; 439/669

[58] Field of Search ..... 439/638–655, 439/217–221, 502–506, 668, 669

[56] References Cited

U.S. PATENT DOCUMENTS

| | | | |
|---|---|---|---|
| 3,662,319 | 5/1972 | Culver | 439/502 |
| 4,097,111 | 6/1978 | Martin . | |
| 4,367,001 | 1/1983 | Munakata . | |
| 4,803,728 | 2/1989 | Lueken . | |
| 4,944,686 | 7/1990 | Gertz . | |
| 4,965,877 | 10/1990 | Gunn | 439/502 |

*Primary Examiner*—David L. Pirlot

[57] ABSTRACT

A plug in connector for audio communication cables, particularly suitable for stereophonic systems. The connector has four terminals, two male and two female, there being two male varieties and two female varieties. Each variety encompasses a particular combination of diameter and length, matching audio industry standard size varieties. In a second embodiment, each terminal threads to the body. This enables a much wider combination of terminals, which may range from all male to all female, as well as including all possible dimensional varieties. The novel connector is generally cruciform, there being a parallelepiped body from which the terminals project. In a first embodiment of the body, the terminals project from opposed faces, all terminals occupying one plane. In another embodiment, the body is generally octagonal, wherein short sides alternating with relatively wider sides. The novel connector enables unparalleled versatility in mating diverse audio cables.

2 Claims, 2 Drawing Sheets

FOUR WAY AUDIO CABLE ADAPTER

BACKGROUND OF THE INVENTION

1. Field of the Invention

The present invention relates to a connector for cables serving audio equipment. The connector has a plurality of terminals enabling connection to a variety of cables. Because the connector has a plurality of terminals, it further enables a plurality of connections to be made simultaneously.

2. Description of the Prior Art

Many types of low voltage, low current, electrically operated equipment, such as audio equipment, are commonly available today. The industry has standardized components to a certain extent, but a great many varieties of components which must interface with other components exist nonetheless.

A prime example of these components is the field of connectors. A connector is typically a friction fit male or female terminal for a communication cable. Commonly used connectors are typically round in front elevation. However, the diameter and length of the prong vary greatly, and the problem of compatibility has therefore arisen.

Adapters for rendering a first style of plug in connector compatible with a second style are known in the prior art. U.S. Pat. Nos. 4,367,001, issued to Yoshitaka Munakata on Jan. 4, 1983; 4,803,728, issued to Jeffrey A. Leuken on Feb. 7, 1989; and 4,944,686, issued to Jonathan Gertz on Jul. 31, 1990, exemplify connectors which are arranged to accept alternative terminals having different characteristics. In each case, the respective terminal is a male terminal superceded by a sole male terminal having other characteristics.

An electrical connector enabling simultaneous connection to a plurality of cables is seen in U.S. Pat. No. 4,097,111, issued to Roger A. Martin on Jun. 27, 1978. This invention provides manifolding capability, but no accommodation of different terminal characteristics is shown or suggested.

In contrast to these examples of the prior art, the present invention provides a plurality of different terminal styles, and a plurality of terminals.

None of the above inventions and patents, taken either singly or in combination, is seen to describe the instant invention as claimed.

SUMMARY OF THE INVENTION

The present invention enables both adaptation of one type of audio cable to another type, and also plural connections for enabling a stereophonic signal to be received by several devices simultaneously. For example, an individual may listen to music on speakers, on a personal headset, and also record the music on still other audio equipment. This connection to disparate equipments is enabled despite the possibility that each individual equipment has cables or terminals different from each other equipment.

Even in those applications wherein a single cable is adapted to one other cable, convenience arises from the variety of possibilities offered by the novel connector.

In a second embodiment, individual terminals are removably attached to the connector, preferably by threading. The novel connector thus may make any combination of terminals possible in one device. A user may obtain additional individual terminals for expanding the capability of the connector without being forced to obtain additional complete connector assemblies.

Accordingly, it is a principal object of the invention to provide a cable connector adapting one terminal style to more than one different terminal style.

It is another object of the invention to provide a plurality of terminals for distributing one audio signal to a plurality of audio components simultaneously.

It is a further object of the invention to distribute one audio signal to a plurality of audio components having different type of cable terminals.

It is an additional object of the invention to enable ready replacement of a terminal in a multi-terminal connector.

It is again an object of the invention to enable replacement of a terminal in a multi-terminal connector while maintaining continuity among the remaining terminals.

Another object of the invention is to minimize the height of a multi-terminal connector.

Yet another object is to provide ample space for grasping and manipulating the connector and associated cable terminals.

Still another object of the invention is to present a distinctive visual appearance.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
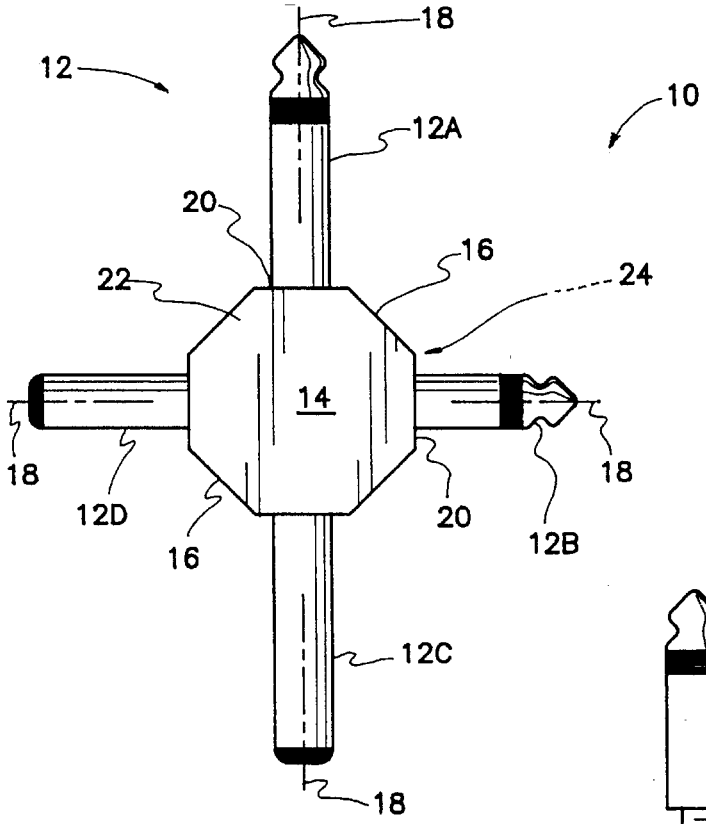
FIG. 1 is a top plan view of a first embodiment of the invention, illustrating four different terminal types combined in one connector.

The general inventive concept is shown with reference to FIG. 1, wherein the novel electrical connector 10 for audio equipment cables is seen to have four terminals 12. A body 14, preferably fabricated from a material having insulating qualities, such as a synthetic resin, partially surrounds terminals 12. It would be possible to fabricate electrical connector 10 without body 14, usable in those circumstances wherein an inadvertent ground does not interfere with successful operation. Body 14 is generally a parallelepiped, four chamfered edges 16 notwithstanding.

Terminals 12 are of the circular, frictionally retained type, and may be either male or female. Each terminal 12 has a longitudinal axis 18, along which terminal 12 is slid relative to a corresponding cable terminal (not shown) to which it connects. Terminals 12 are pushed into interlocking relation with these corresponding cable terminals, and may be rotated without disturbing either the electrical or mechanical connection with the respective cable terminal.

Each terminal 12 conventionally comprises at least one electrical conductor (not shown). In the present invention, each conductor is electrically connected in common with a corresponding conductor of each other terminal 12. Terminals may, where desired, comprise two or more conductors connected in common with corresponding conductors of all other terminals 12. In this fashion, electrical signals imposed upon any one terminal 12 are simultaneously distributed to all terminals 12 of any one electrical connector 10.

Electrical connector 10 is arranged as a cruciform, axes 18 of all terminals 12 occupying a common plane. An opposed pair of terminals 12 has respective axes 18 disposed in aligned orientation. Axes 18 of the other pair of terminals 12 are disposed out of aligned orientation with respect to the first opposed pair of terminals 12.

Body 14 has opposed pairs of flat facets 20, one terminal 12 projecting from any one facet 20. Body 14 also has upper and lower flat surfaces 22,24. This geometry has several advantages, including causing connector 10 to be essentially flat, in that it will rest stably on a flat environmental surface, and will not unduly project upwardly from this surface. Also, terminals 12 are reasonably spaced apart, so that there is ample room to grasp and manipulate connector 10 and audio cables being connected thereto. Furthermore, there is at least one pair of axially aligned terminals 12, so that linear connection of two audio cables is conveniently enabled.

In the depiction of FIG. 1, two terminals 12A,12B are male and two terminals 12C,12D are female. Male terminals 12A,12B are of different dimensional characteristics. Dimensional characteristics include diameter and axial length of the exposed portion of a respective terminal 12. Similarly, terminals 12C,12D have different dimensional characteristics. The combination of dimensional and male/female characteristics enables any one of three types of cable terminals to be operably connected to a fourth type of cable terminal.

Still other characteristics which may differ include the presence or absence of enlarged heads, referring to male terminals 12A,12B, or corresponding sockets (not shown), referring to female terminals 12C,12D. Still other characteristics which can vary when dimensional characteristics and male/female characteristics are constant include, illustratively, presence or absence of O-rings or other devices for augmenting frictional engagement and different materials.

Figure 2:
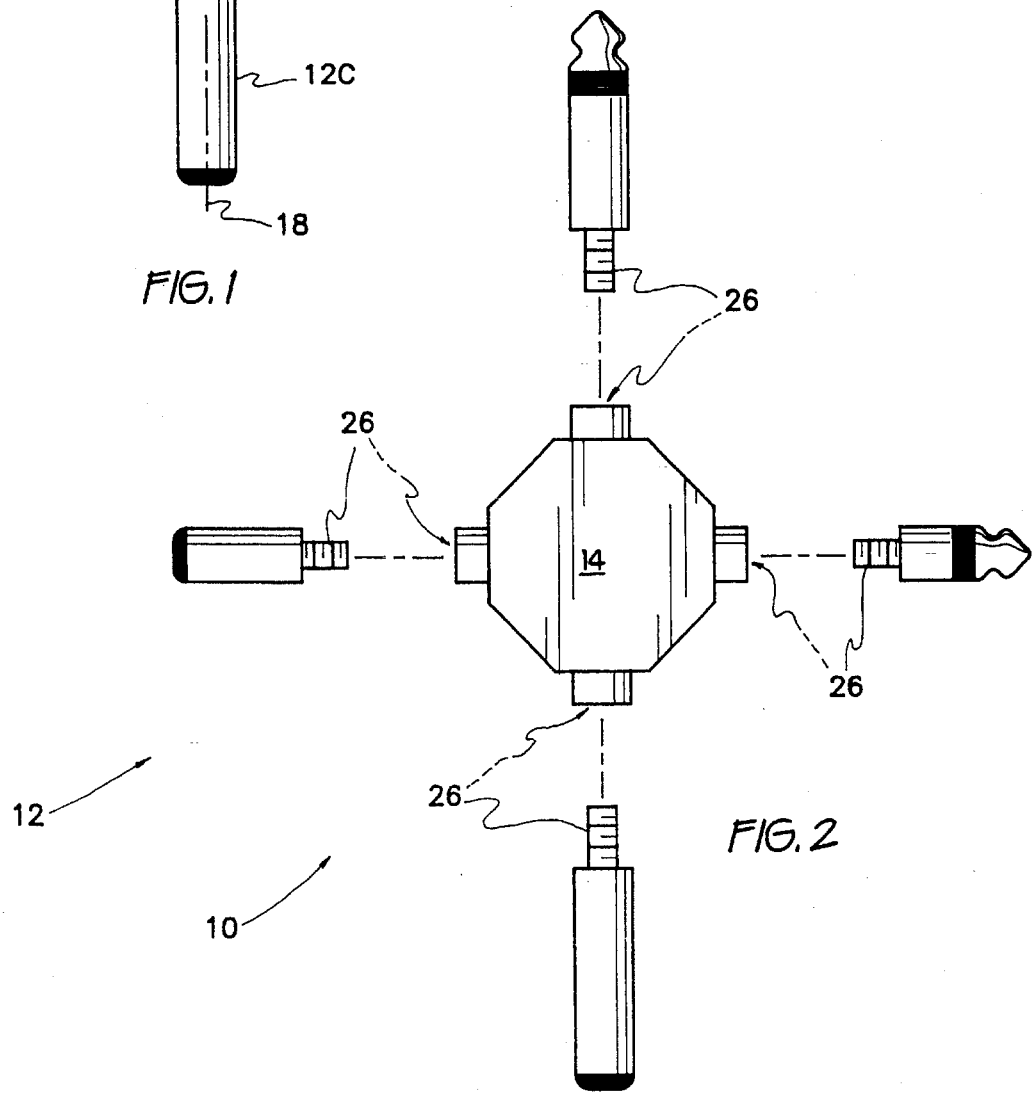
FIG. 2 is a top plan view of a second embodiment of the invention, illustrating removable terminals.

Turning now to FIG. 2, in an alternative embodiment of the invention, terminals 12 are individually removable from body 14. Attachment is preferably by threads 26, although terminals 12 could plug into body 14, or be attached in still other ways not requiring tools. The advantage derived by this arrangement is that the variety of terminal characteristics can be greatly expanded merely by attaching an appropriate terminal 12. Identical terminals 12 can be installed, thereby distributing an input signal to a plurality of audio cables of identical type or characteristics. Also, a defective terminal 12 can be renewed without replacing the entire connector 10, so that continuity to several audio cables is possible while replacing one terminal 12.

Figure 3:
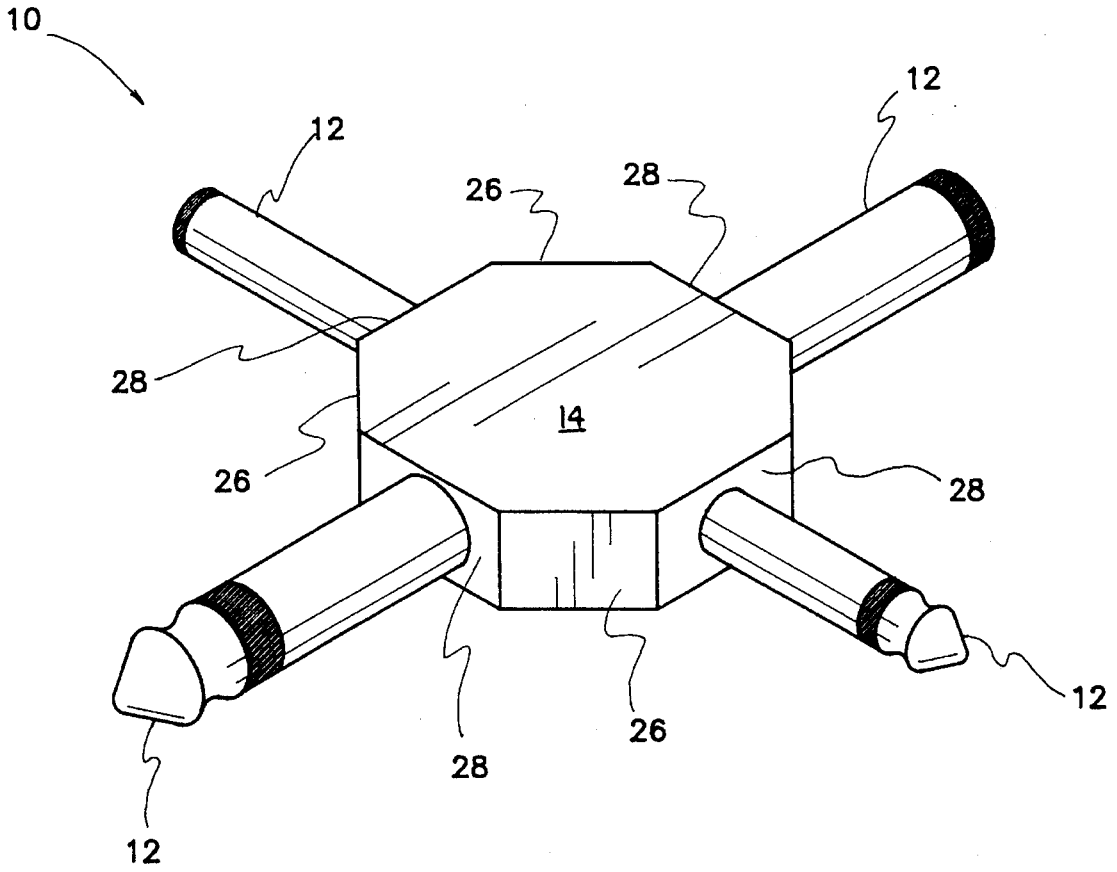
FIG. 3 is a top plan view of a third embodiment of the invention wherein the body has a different configuration. The body is compatible with either of the first and second embodiments.

A preferred body design is illustrated in FIG. 3. Body 14 includes four first facets 28 arranged in opposed pairs. Terminals 12 project from these first facets 28. Four second facets 30 separate any two adjacent first facets 28. This arrangement provides even more space for grasping and manipulating around each terminal 12. It also creates a distinctive visual effect, useful in identifying a connector 10 when other components and parts (not shown) are present.

Although the novel connector 10 has been described with reference to audio signals, this is merely a preferred application. The present invention would be suitable for many applications, not merely communications, nor only for low voltage DC current applications. Therefore, it is to be understood that the present invention is not limited to the embodiments and usages described above, but encompasses any and all embodiments and usages within the scope of the following claims.

I claim:

1. An electrical connector having:

a plurality of conductive terminals having corresponding conductors electrically connected in common, all said terminals being of the circular, frictionally retained type having a longitudinal axis, at least one of said terminals having characteristics different from another one of said terminals, and at least one said axis being disposed out of aligned orientation with another said axis; and a body having first facets for each one of said terminals, each one of said terminals projecting from one said first facet, and said axes occupying a common plane, said body being rectangular and having four said first facets arranged in opposed pairs of said first facets, one of said terminals disposed upon each said first facet.

2. An electrical connector having:

a plurality of conductive terminals having corresponding conductors electrically connected in common, all said terminals being of the circular, frictionally retained type having a longitudinal axis, at least one of said terminals having characteristics different from another one of said terminals, and at least one said axis being disposed out of aligned orientation with another said axis; and a body having first facets for each one of said terminals, each one of said terminals projecting from one said first facet, and said axes occupying a common plane, and having second facets, each one of said second facets located between adjacent ones of said first facets, said body having four of said first facets, four said terminals projecting therefrom, and four of said second facets separating said first facets from one another.

* * * * *